US006260284B1

(12) United States Patent
Su

(10) Patent No.: US 6,260,284 B1
(45) Date of Patent: Jul. 17, 2001

(54) ALIGNING APPARATUS FOR ALIGNING SIDES OF A STACK OF PAPERBOARDS CARRIED TOWARD A PAPERBOARD PROCESSING DEVICE

(76) Inventor: Wu-Shuan Su, No. 79, Chiao-Cheng Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/438,201

(22) Filed: Nov. 11, 1999

(51) Int. Cl.[7] ..... G01D 21/00; B41J 11/58; B65H 1/04

(52) U.S. Cl. ..... 33/645; 33/614; 400/630

(58) Field of Search ..... 33/645, 614, 613, 33/623, 533; 400/625, 623, 624, 632, 605, 646, 647, 279, 283, 294, 303, 472, 477, 703, 705, 300, 479, 630, 632.1, 633, 633.2; 271/8.1, 3.14

(56) References Cited

U.S. PATENT DOCUMENTS 4,786,044 * 11/1988 Moody ..... 271/171
4,966,355 * 10/1990 Katafuchi et al. ..... 271/3.1
5,511,770 * 4/1996 Okazaki ..... 271/4.01
5,785,441 * 7/1998 Kobayashi et al. ..... 400/633
5,803,631 * 9/1998 Bingham et al. ..... 400/624
5,921,691 * 7/1999 Kobayashi et al. ..... 400/634
6,170,727 * 1/2001 Hevenor et al. ..... 226/21

FOREIGN PATENT DOCUMENTS

05254208A * 10/1993 (JP) .

* cited by examiner

*Primary Examiner*—G. Bradley Bennett
*Assistant Examiner*—Gail Verbitsky
(74) *Attorney, Agent, or Firm*—Townsend and Townsend and Crew LLP

(57) ABSTRACT

An aligning apparatus includes a carrier moving along a guided straight path for carrying a paperboard stack between a stack aligning position and a stack feeding position. When the carrier is in the stack aligning position, a first electrically driven positioning member is disposed to move a first aligning member to an extended position where a lateral outreach of the stack is set in accordance with the width of the stack. A second aligning member has a second upright flat wall with an abutment surface in a direction transverse to the guided straight path to define a front outreach of the paperboard stack when the carrier is in the stack aligning position. As such, the paperboard stack on the carrier can be aligned and moved directly toward the paperboard processing device thereafter.

16 Claims, 14 Drawing Sheets

ALIGNING APPARATUS FOR ALIGNING SIDES OF A STACK OF PAPERBOARDS CARRIED TOWARD A PAPERBOARD PROCESSING DEVICE

BACKGROUND OF THE INVENTION

1. Field of the Invention

This invention relates to an aligning apparatus, more particularly to an automated aligning apparatus for aligning sides of a stack of paperboards carried toward a paperboard processing device.

2. Description of the Related Art

A conventional way to align sides of a stack of paperboards for carrying toward a paperboard processing device, such as a printing machine, is to stack the paperboards at a corner of a factory with various lines in accordance with the sizes of the paperboards, thereby resulting in the need for a relatively large operating area. A lifter is then used to move the stacked paperboards toward the processing device for machining. As such, there is a tendency that the paperboards will deviate from their aligning positions, and it is labor-intensive to perform manual alignment of the paperboards on a feeding side of the processing device. In addition, the lifter needs a relatively large space for movement.

SUMMARY OF THE INVENTION

The object of the present invention is to provide an aligning apparatus adapted to be mounted adjacent to a paperboard processing device for aligning sides of a stack of paperboards prior to a processing operation.

According to this invention, an aligning apparatus includes a slidable carrier for carrying a paperboard stack and disposed to move along a guided straight path in a longitudinal direction from a stack aligning position to a stack feeding position. A first aligning member is disposed adjacent to the carrier when the carrier is in the stack aligning position such that the first aligning member is movable relative to a lateral edge portion of the carrier, and includes a first upright flat wall with a first abutment surface parallel to the lateral sides of the paperboard stack and a profile higher than the height of the stack. A first electrically driven positioning member is disposed to move the first aligning member when the carrier is in the stack aligning position between an extended position, where the first aligning member is proximate to the lateral edge portion, and a lateral outreach of the paperboard stack is set in accordance with a width of the stack, and a first retracted position where the first aligning member is distal to the lateral edge portion. A second aligning member includes a second upright flat wall having a second abutment surface in a transverse direction relative to the longitudinal direction and a profile higher than the height of the paperboard stack. The second aligning member is disposed adjacent to the carrier when the carrier is in the stack aligning position such that the second aligning member is proximate to a front edge portion of the carrier so that the second abutment surface defines a front outreach of the paperboard stack.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
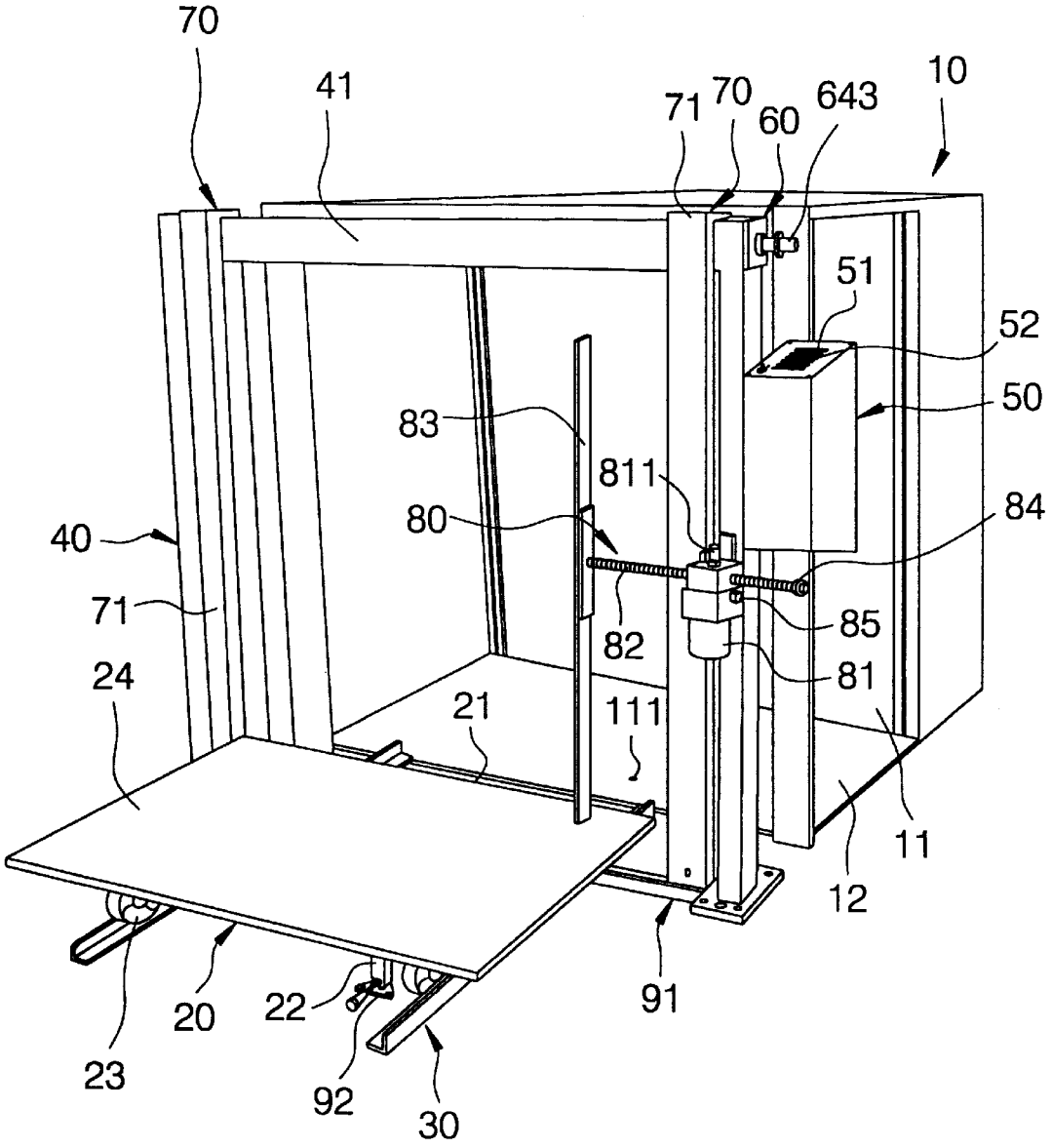
FIG. 1 is a perspective view of a first preferred embodiment of an aligning apparatus according to this invention.

Before the present invention is described in greater detail, it should be noted that same reference numerals have been used to denote like elements throughout the specification.

Figure 2:
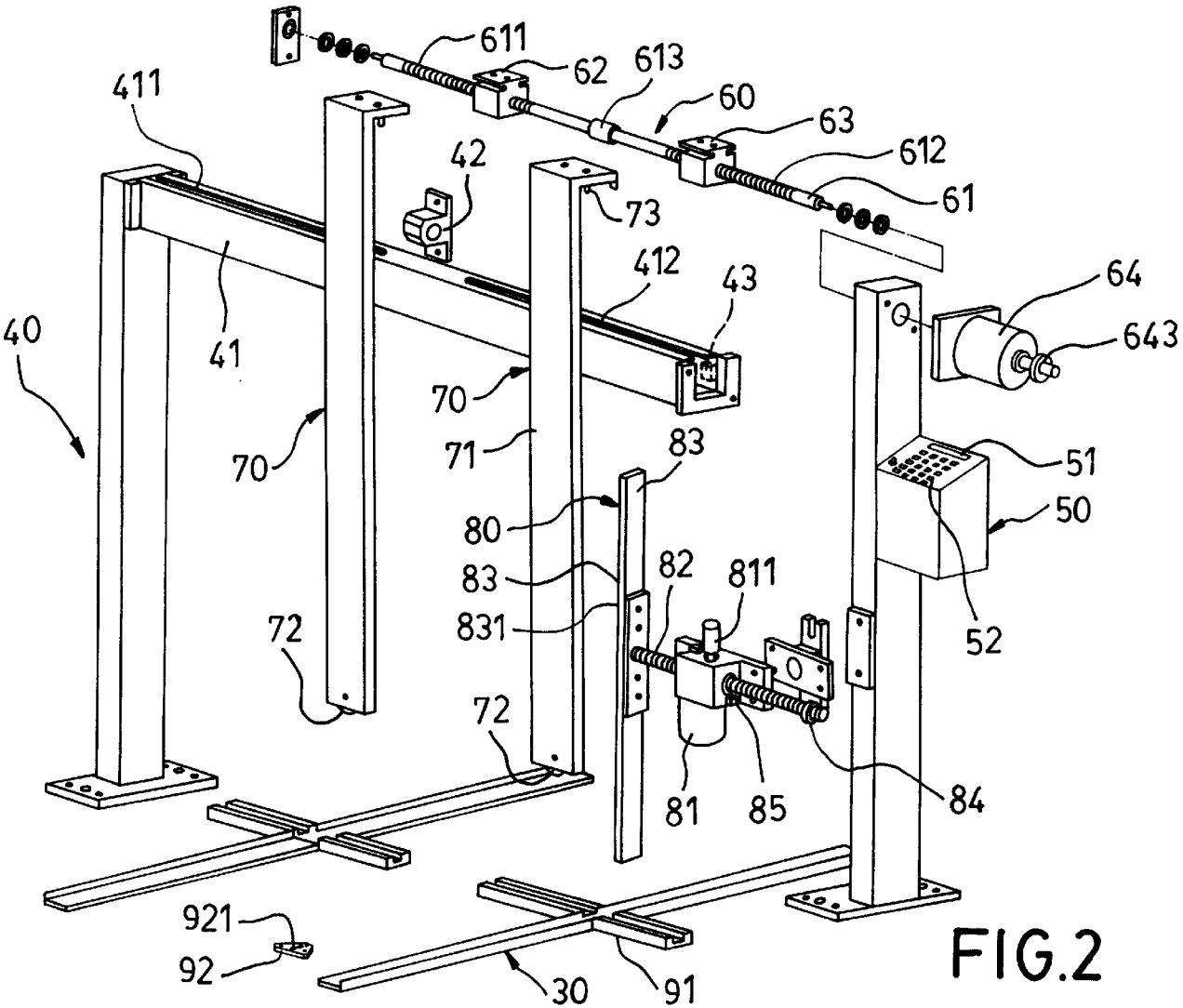
FIG. 2 is an exploded view of the apparatus in FIG. 1.

Referring to FIGS. 1 and 2, the first preferred embodiment of an aligning apparatus according to the present invention is shown to be mounted at a paperboard feeding side 11 of a paperboard processing device, such as a printing machine 10. The apparatus includes a carrier rail 30 mounted on the ground and extending in a longitudinal direction toward the feeding side 11, and a carrier 20 with wheels 23 rolling along the rail 30 from a stack aligning position to a stack feeding position adjacent to the printing machine 10. The carrier 20 includes a platform 24 with two lateral edge portions, a front edge portion 21 and a rear edge portion that correspond respectively to the lateral sides 101, the front side 102 and the rear side of a paperboard stack 100 (see FIG. 6) that is placed on the platform 24. A support frame 40 straddles the rail 30, and has a hollow transverse rod portion 41 formed with two slide slots 411,412 therein.

A first aligning rod 80 includes a first upright flat wall 83 having a first abutment surface 831 and a profile higher than the height of the paperboard stack 100. The first upright flat wall 83 is mounted to one end of a first electrically driven positioning rod 82. The rod 82 extends transversely and is driven by a first servomotor 81 mounted securely on one side of the frame 40 so that, when the carrier 20 is in the stack aligning position, the rod 82 can move the wall 83 in a transverse direction between an extended position proximate to a lateral edge portion of the carrier 20, and a first retracted position distal to the lateral edge portion. The other end of the rod 82 has an induction ring 84 sleeved thereon to correspond to a sensor 85 mounted on the first servomotor 81. The sensor 85 is connected electrically to a programmable controller 50. The first servomotor 81 has an encoder 811 corresponding to a setter 51 of the controller 50.

Figure 3:
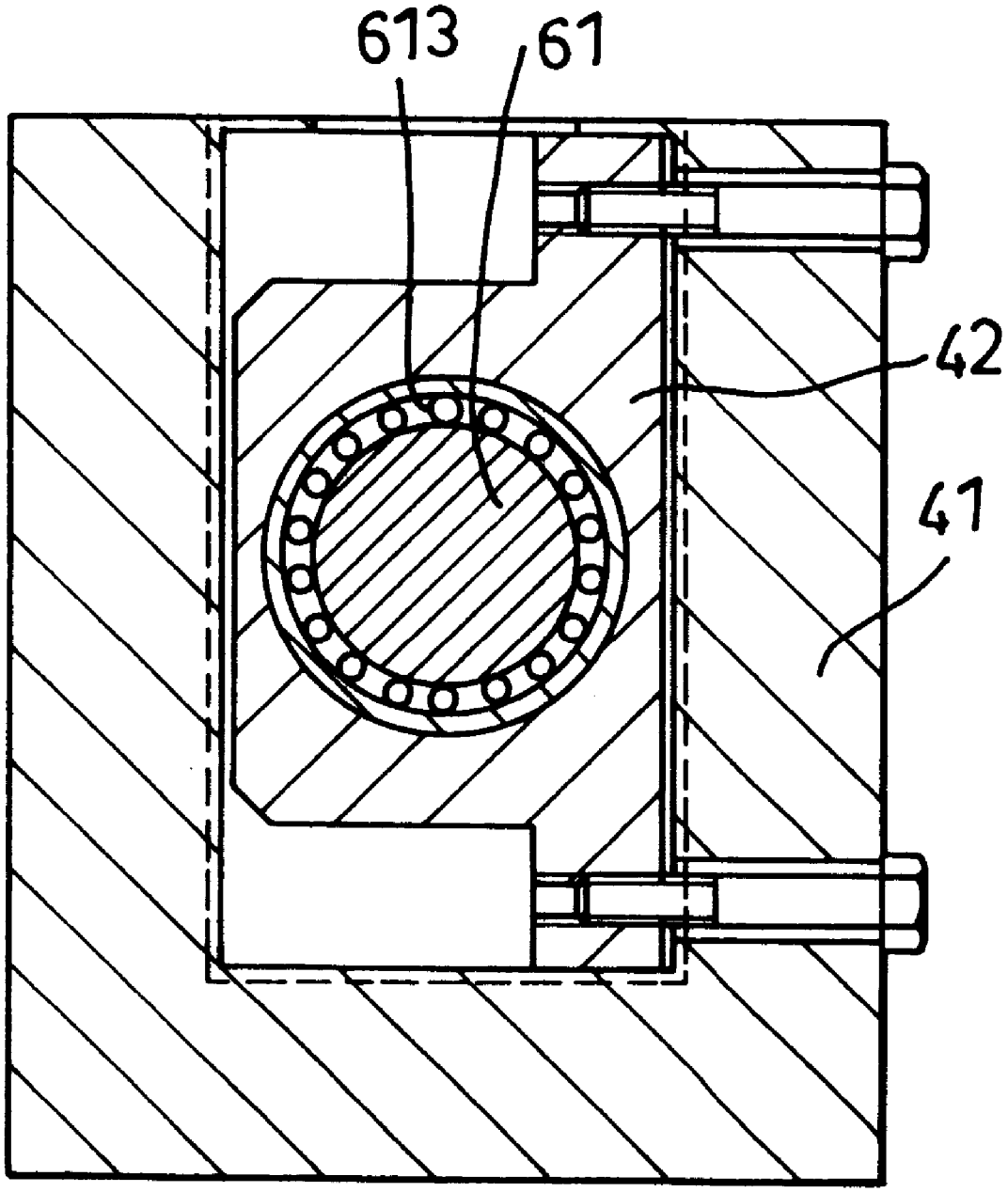
FIG. 3 is a cross-sectional view of a transverse rod portion of a support frame on the apparatus in FIG. 1.
Figure 4:
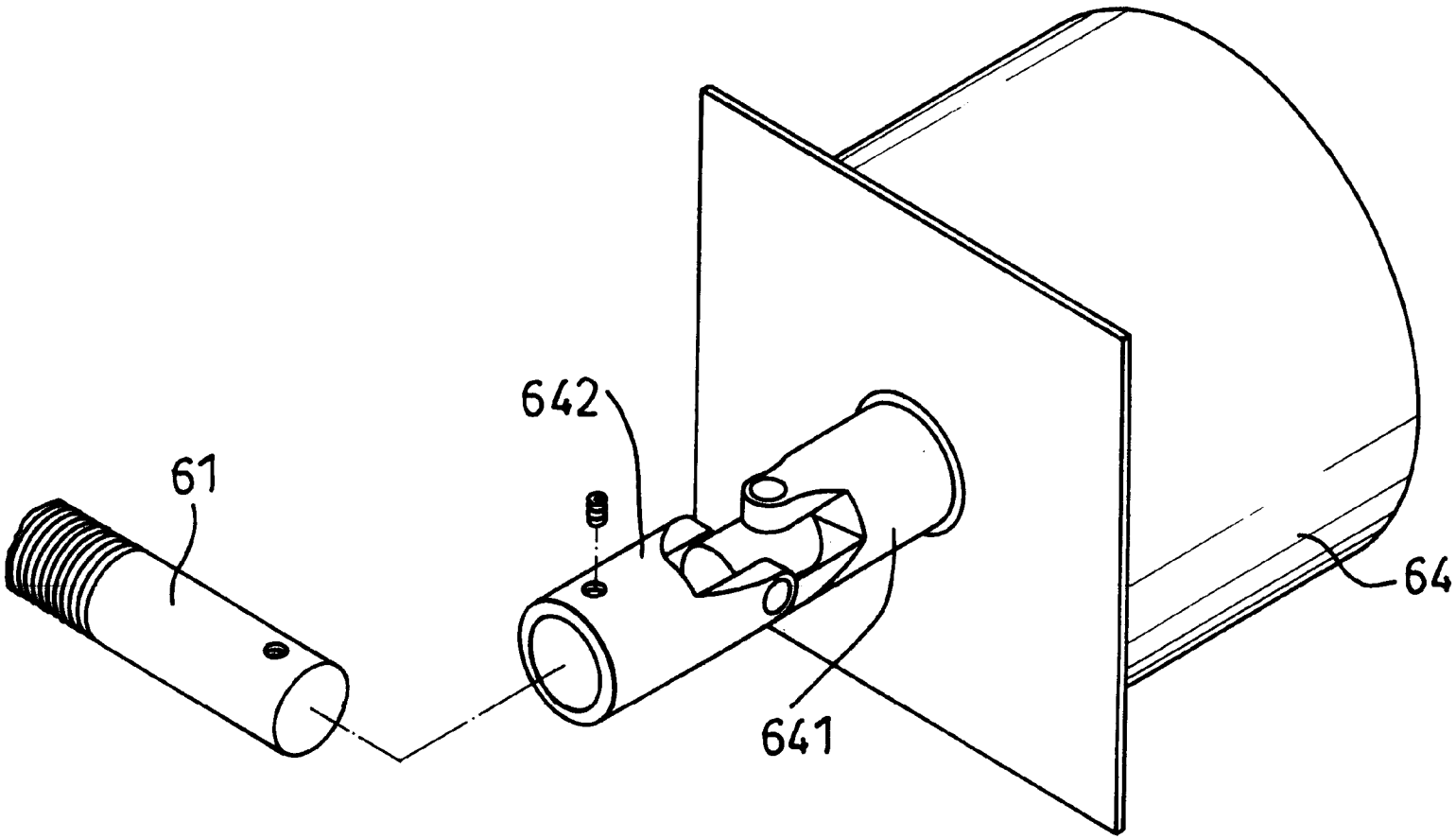
FIG. 4 is a perspective view showing an axle of a servomotor connected to a positioning rod via a cardan joint.

With reference to FIGS. 2, 3 and 4, a position adjusting mechanism 60 includes a transverse positioning rod 61 mounted in the rod portion 41 and having a forward thread portion 611 and a reverse thread portion 612 on which two sliding blocks 62,63 are mounted respectively so as to permit the sliding blocks 62,63 to slide along the rod 61 in opposite directions by means of rotation of the rod 61. A bearing 613 is mounted between the thread portions 611,612 and is coupled to a bearing seat 42 in the rod portion 41. A second servomotor 64 is disposed on one side of the frame 40, and an axle 641 (see FIG. 4) thereof is connected to one end of the rod 61 via a cardan joint 642. In addition, an encoder 643 is provided on the second servomotor 64 corresponding to the setter 51 so that the second servomotor 64 can be controlled to rotate the rod 61.

Figure 5:
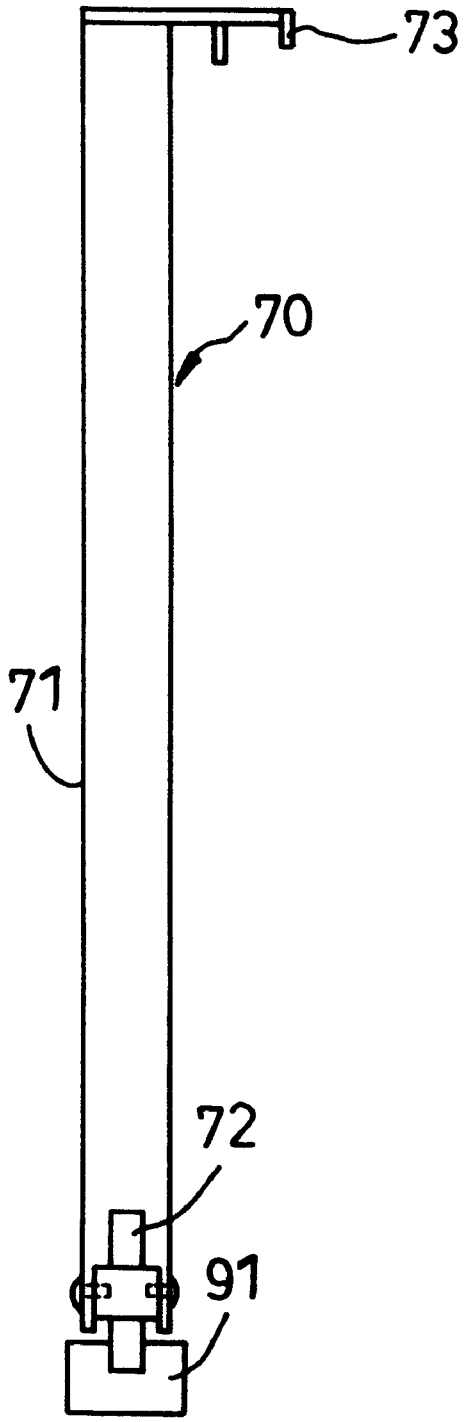
FIG. 5 is a side view showing a second aligning member of the apparatus.
Figure 6:
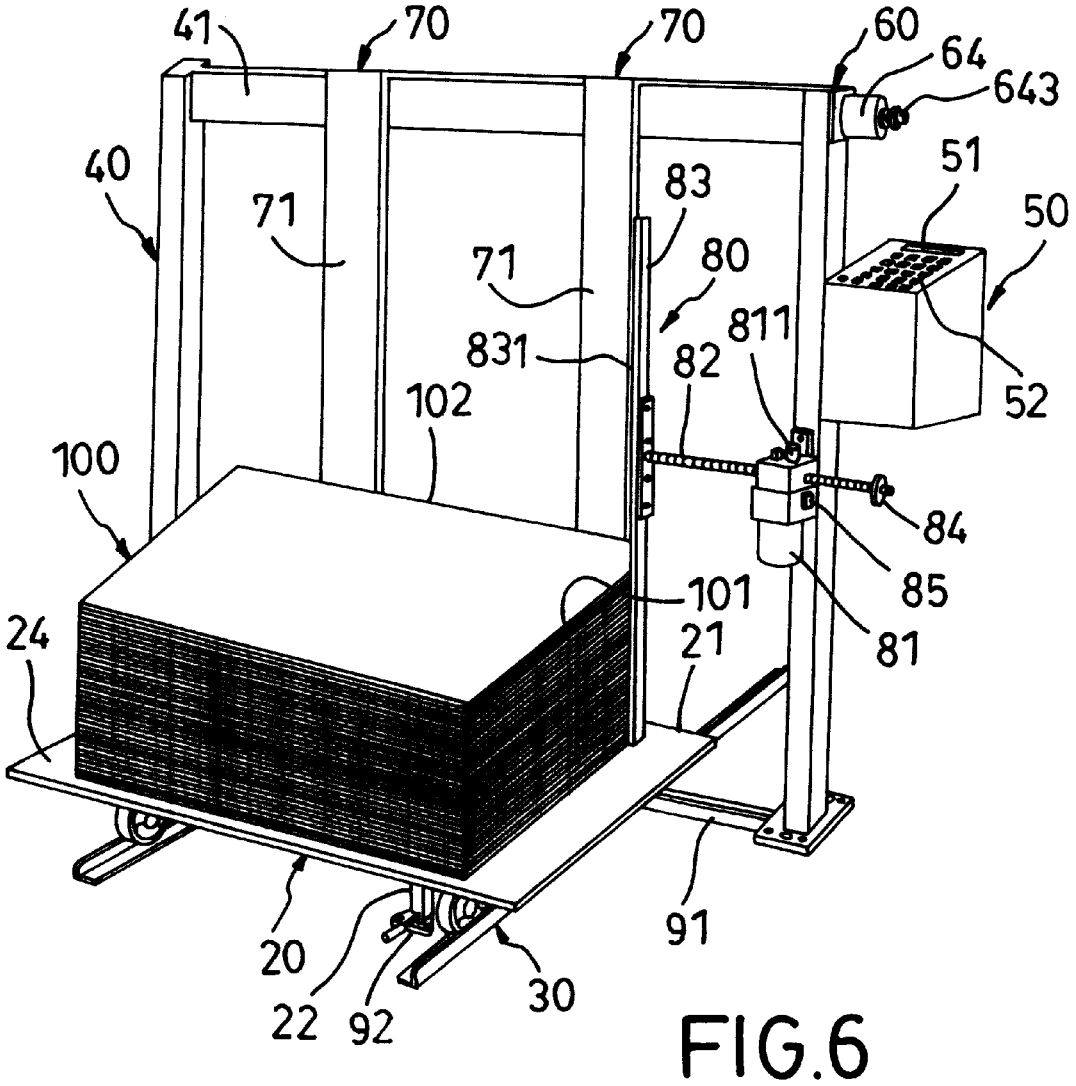
FIG. 6 is a perspective view of the apparatus in use.

Referring again to FIG. 2, a second aligning member includes two second upright flat walls 70 with second abutment surfaces 71 in the transverse direction and a profile higher than the height of the paperboard stack 100 (see FIG. 6). Upper ends of the walls 70 are secured to the sliding blocks 62,63 respectively so as to move in the transverse direction between a barrier position to serve as a barrier for the paperboard stack 100, and a second retracted position to steer clear of the rail 30. In addition, referring to FIGS. 1, 2 and 5, a transverse rail 91 is disposed on the ground under the rod portion 41. Lower ends of the walls 70 are provided with wheels 72 for rolling along the rail 91 to facilitate smooth movement. Induction plates 73 are provided on the upper ends of the walls 70 to correspond with a sensor 43 mounted on the rod portion 41. The sensor 43 is connected electrically to the controller 50 so as to provide additional protection during movement of the walls 70.

Figure 7:
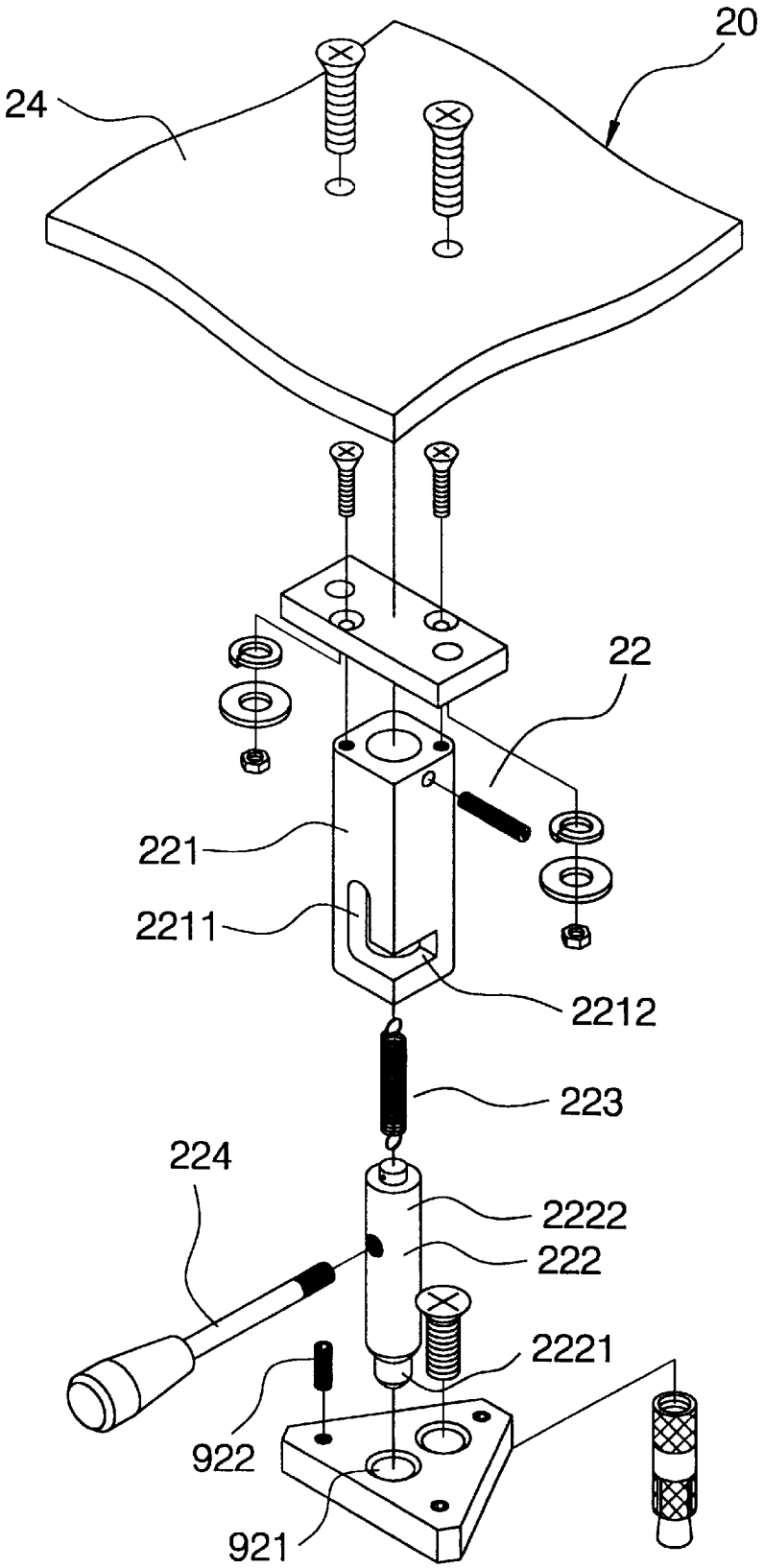
FIG. 7 is an exploded perspective view of a positioning mechanism of the apparatus.

Referring to FIGS. 1 and 7, a positioning mechanism 22 is mounted under the platform 24 of the carrier 20. The positioning mechanism 22 includes a casing 221 which is secured on an underside of the platform 24. The casing 221 has a receiving space formed therein, and an L-shaped groove which is communicated with the receiving space and which includes a sliding portion 2211 extending normal to the platform 24 and a positioning portion 2212 extending transversely of the sliding portion 2211. A positioning rod 222 is received in the receiving space of the casing 221, and has upper and lower ends 2222,2221 opposite to each other in the normal direction. The positioning rod 222 is disposed to be movable downwardly and to have the lower end 2221 outwardly of the casing 221. A biasing spring 223 is disposed in the receiving space and engages the upper end 2222 of the positioning rod 222 to bias the positioning rod 222 upward so as to retract the lower end 2221 inwardly of the casing 221. An operating rod 224 is connected the positioning rod 222 and extends outwardly of the L-shaped groove such that the downward movement of the operating rod 224 along the sliding portion 2211 can move the positioning rod 222 downward to extend the lower end 2221 outwardly of the casing 221 against the biasing action of the biasing spring 223. In addition, when the operating rod 224 is moved in the positioning portion 2212, the positioning rod 222 can be rotated relative to the casing 221 so as to be held from moving upward. A positioning seat 92 is secured on the ground by adjusting screws 922, and has a first positioning hole 921 which is located under the positioning rod 222 when the carrier 20 is in the stack aligning position. A second positioning hole 111 is formed in a front bottom plate 12 of the printing machine 10, and is located under the positioning rod 222 when the carrier 20 is in the stack feeding position.

Figure 8:
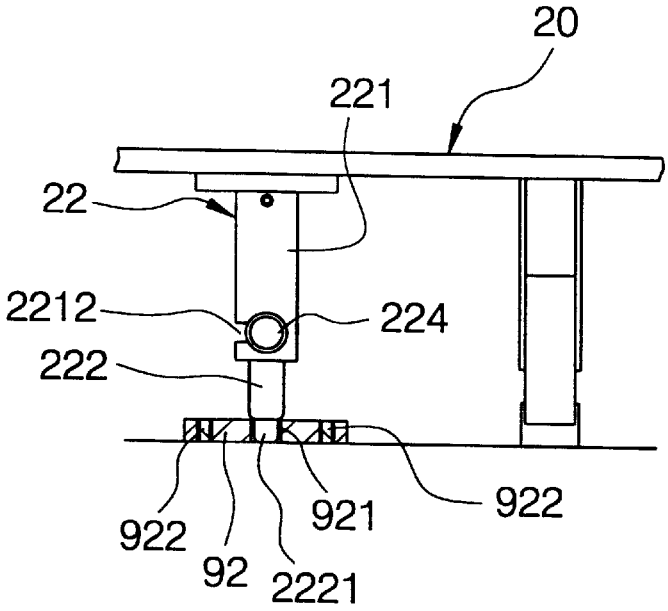
FIG. 8 is a schematic view of the positioning mechanism in a stack aligning state.
Figure 9:
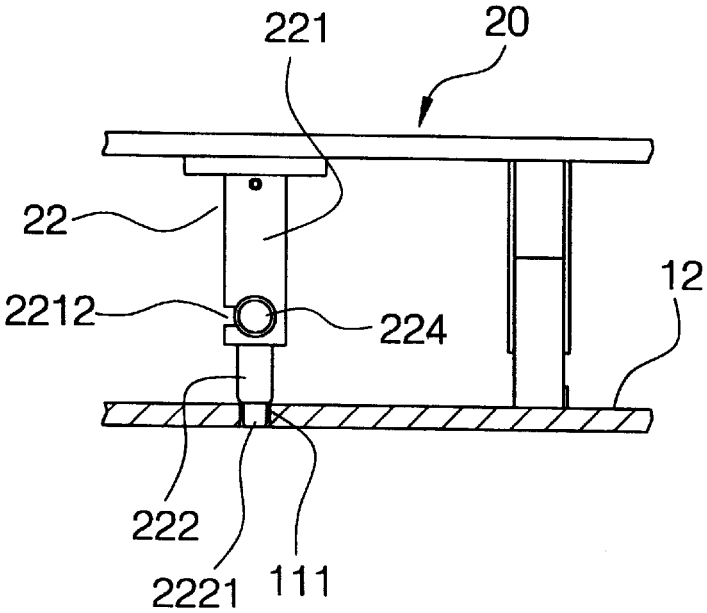
FIG. 9 is a schematic view of the positioning mechanism in a stack feeding state.

In operation, with reference to FIG. 6, when the carrier 20 is placed in the stack aligning position, the setter 51 of the controller 50 can be used to set a desired lateral outreach of the paperboard stack 100 and a distance between the walls 70 in accordance with the width and length of the paperboard stack 100. Switch buttons 52 are pushed for controlling the first and second servomotors 64,81 via the encoders 643,811. The first aligning rod 80 is thus moved in the extended position proximate to the lateral side 101, and the second upright flat walls 70 are moved toward the barrier position. In addition, with reference to FIGS. 7 and 8, the operating rod 224 is operated downward along the sliding portion 2211 against the biasing action of the biasing spring 223 to move the positioning rod 222 downward, and is turned toward the positioning portion 2212 such that the positioning rod 222 is rotated to be held from moving upward, and the lower end 2221 thereof enters the first positioning hole 921. Thus, the carrier 20 is positioned in the stack aligning position. As such, the paperboard stack 100 can be pushed such that the front side and one of lateral sides thereof abut against the second and first abutment surfaces 71,831 for alignment. When the aligning process of the paperboard stack 100 has been completed, the operating rod 224 is operated back to the sliding portion 2211 to move the positioning rod 222 to retract upward from the first positioning hole 921. Then, by operating the controller 50, the first and second upright flat walls 83,70 are moved respectively toward the first and second retracted positions so as to prevent obstruction of subsequent movement of the carrier 20 adjacent to the stack feeding position toward the printing machine 10. After the carrier 20 is moved in the stack feeding position, with reference to FIG. 9, the operating rod 224 is operated toward the positioning portion 2212 in the above manner so as to retain the lower end 2221 of the positioning rod 222 in the second positioning hole 111.

Figure 10:
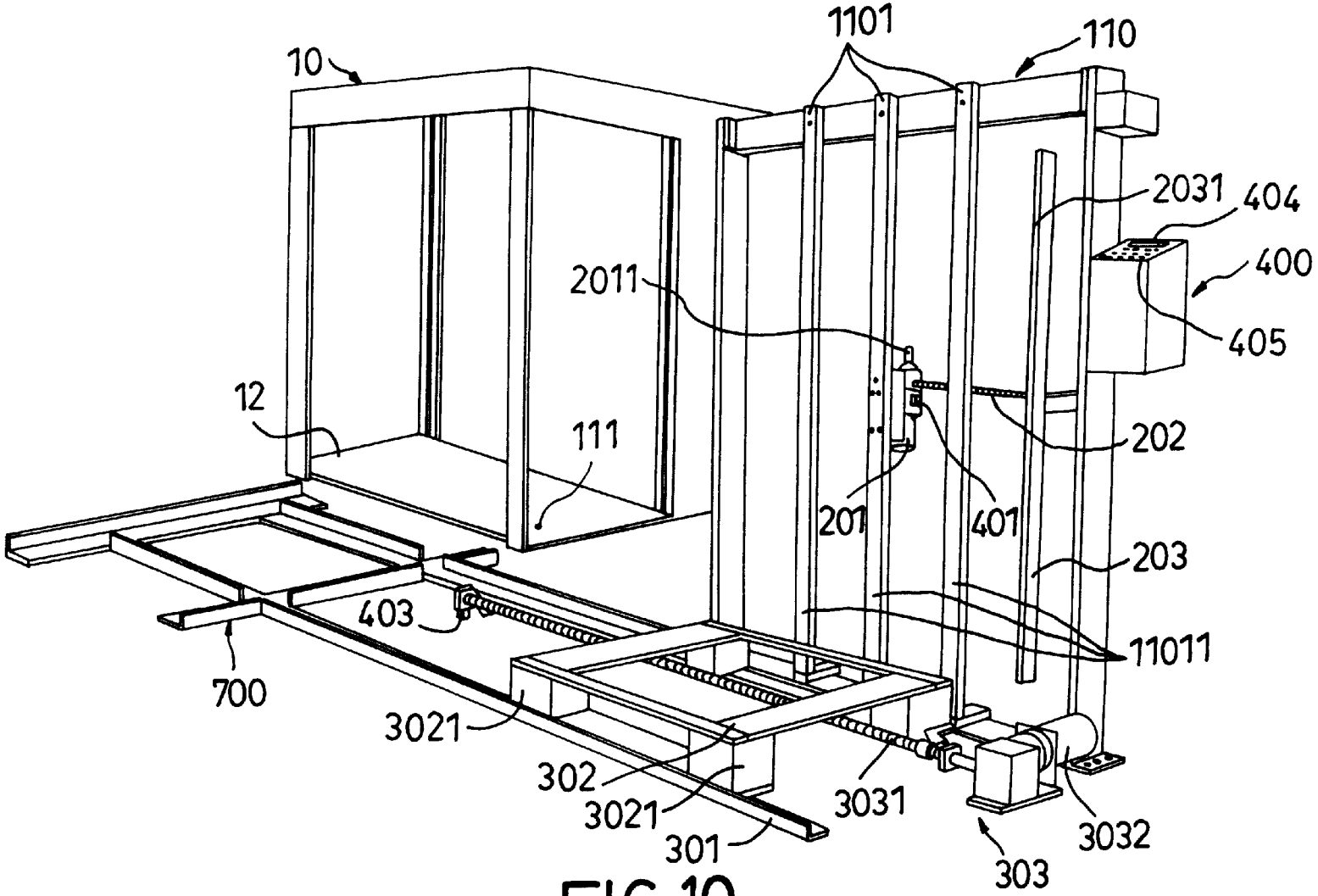
FIG. 10 is a perspective view of a second preferred embodiment of an aligning apparatus according to this invention.
Figure 11:
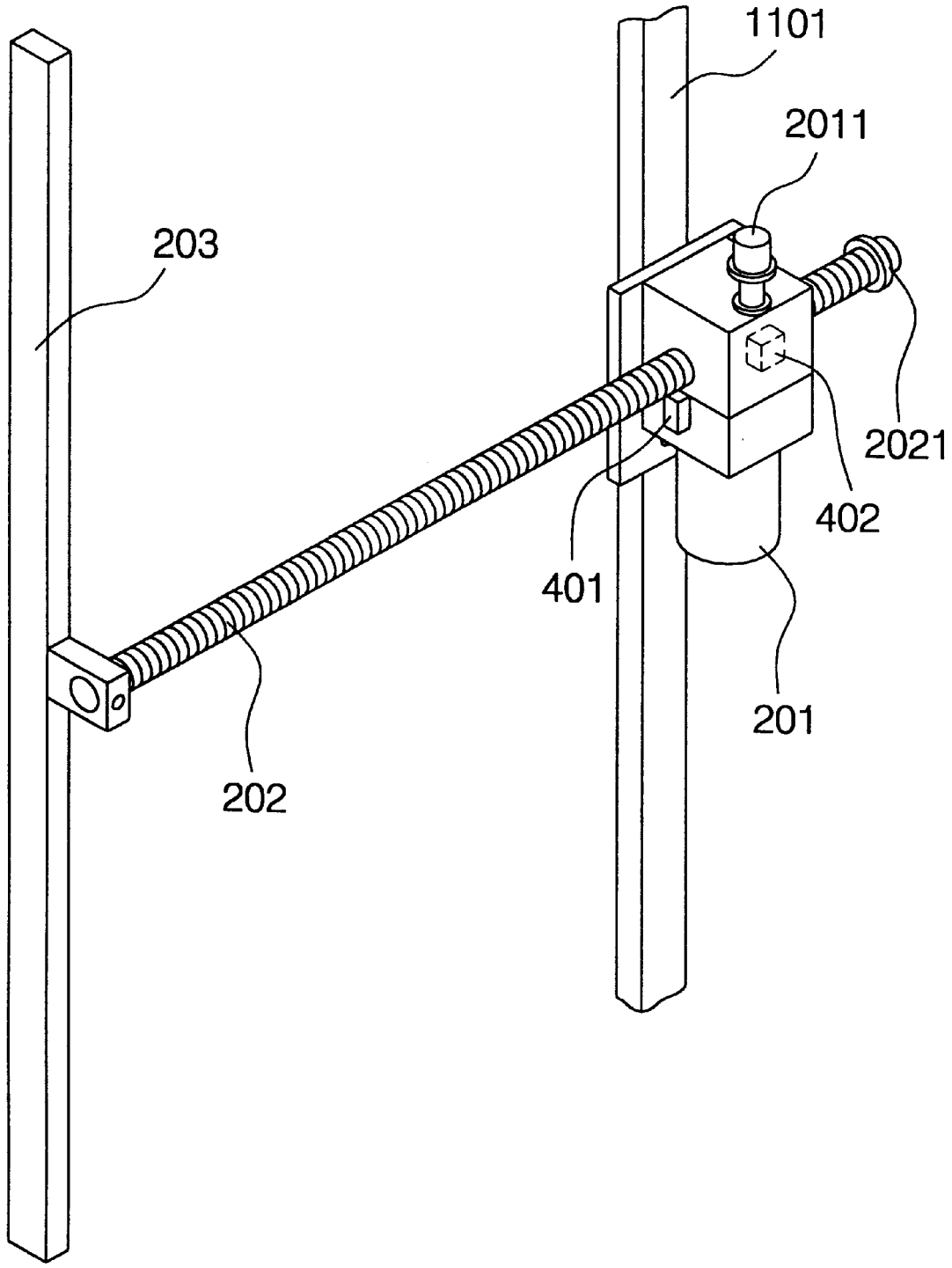
FIG. 11 is a perspective view showing a first aligning rod, a first electrically driven positioning rod and a first servomotor of the second preferred embodiment.
Figure 14:
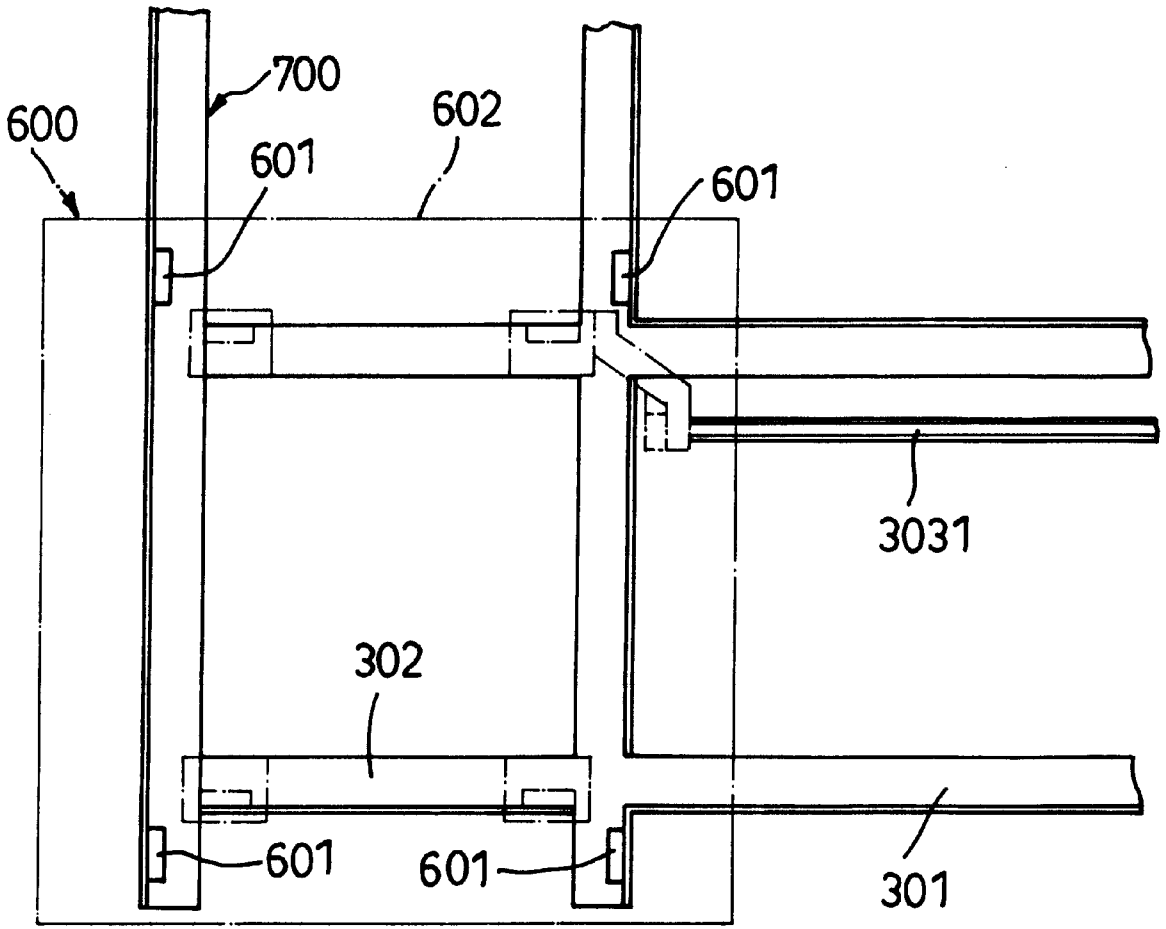
FIG. 14 is a schematic view showing how a carrier is moved toward a carrier rail by the loading carrier.

Referring to FIGS. 10 and 11, the second preferred embodiment of the aligning apparatus according to this invention is shown to further include a preparatory straight rail 301 provided upstream of and criss-crossing a carrier rail 700 for permitting the aligning process of the paperboard stack to be carried out thereon. A loading carrier 302 is slidable on the preparatory straight rail 301 in a stack aligning position for loading a carrier 600 (as shown in FIG. 14). A support frame 110 is mounted beside the printing machine 10 adjacent to the preparatory rail 301 for mounting a first aligning rod 203, a first electrically driven positioning rod 202 and a first servomotor 201 whose constructions are the same as those in the first embodiment. The first aligning rod 203 can be moved between extended and retracted positions relative to the preparatory straight rail 301. A calibrating ring 2021 is sleeved on the rod 202 at one end. An encoder 2011 is provided on the first servomotor 201.

A plurality of second upright flat walls 1101 with second abutment surfaces 11011 are secured to the frame 110, and are in line with and are parallel to the preparatory straight rail 301. As illustrated, the first abutment surface 2031 of the first aligning rod 203 in the extended position and the second abutment surfaces 11011 serve as barriers to front and lateral sides of a paperboard stack (not shown) as the paperboard stack is pushed toward the same.

Figure 12:
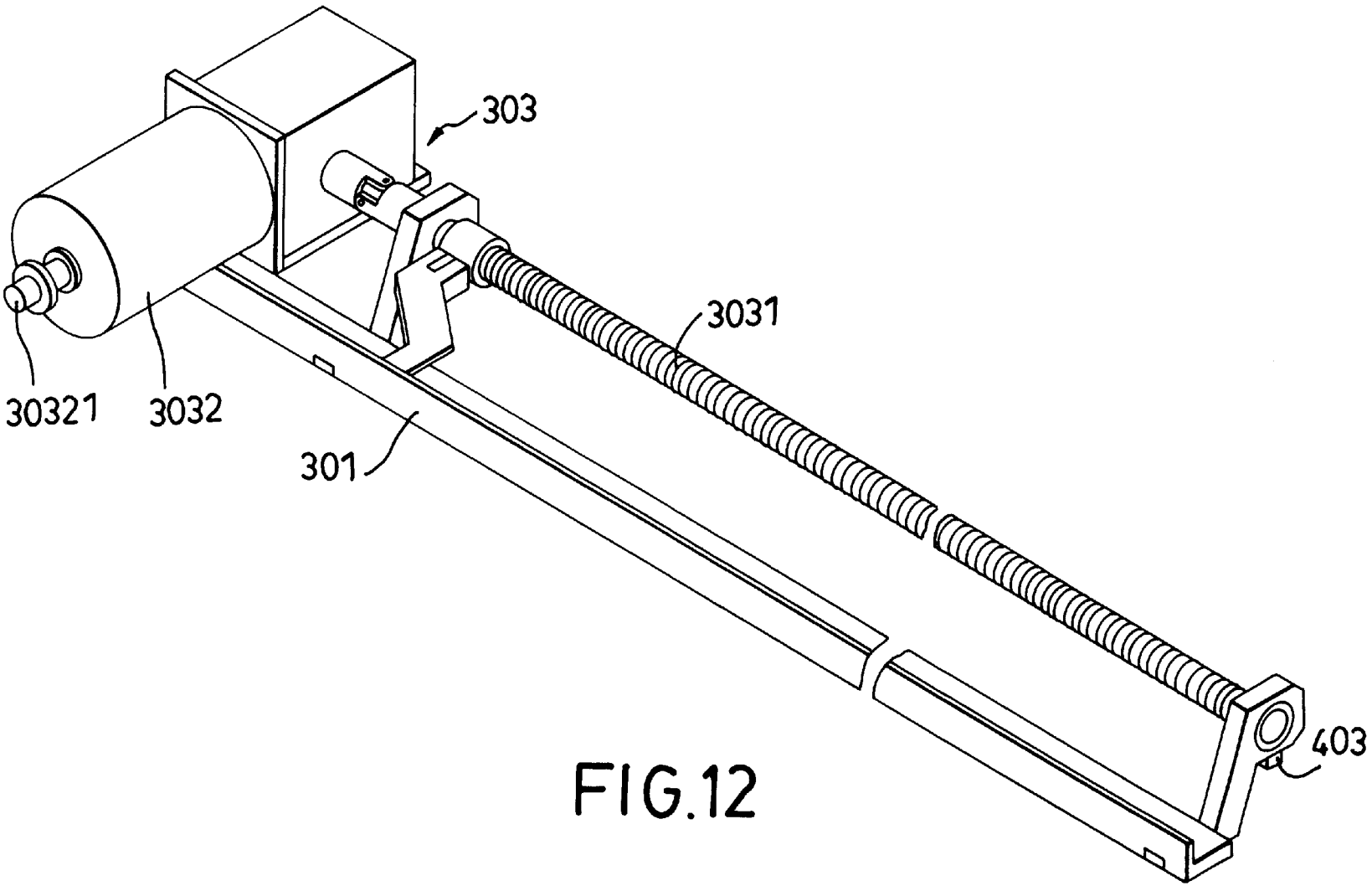
FIG. 12 is a perspective view showing a preparatory straight rail and a carrier transmitting mechanism of the apparatus in FIG. 10.
Figure 13:
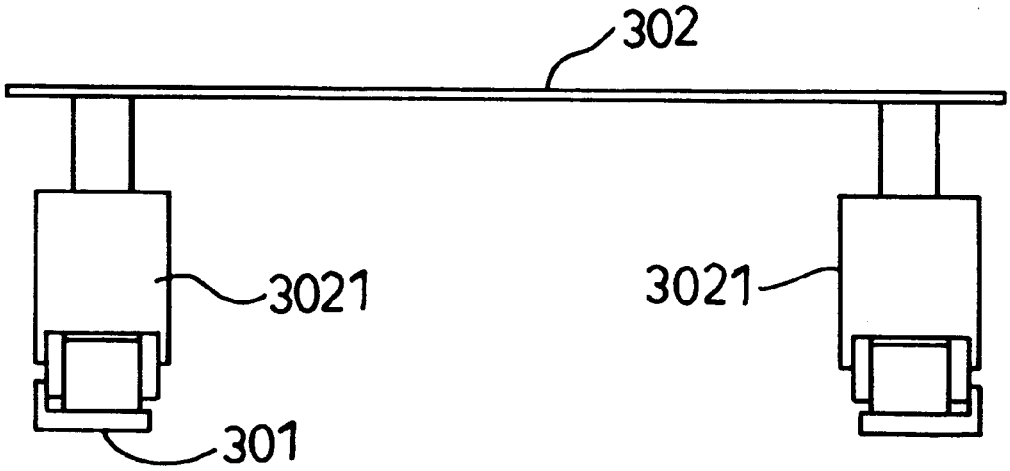
FIG. 13 is a schematic view showing a loading carrier in a lifted state.

With reference to FIGS. 10, 12 and 13, a carrier transmitting mechanism 303 includes a third servomotor 3032 and a threaded rod 3031 driven by the third servomotor 3032 to rotate so as to move the loading carrier 302 along the rail 301 to a stack feeding position once the aligning process has been completed. The loading carrier 302 has four rectangular pressure cylinders 3021 at four edges so as to lift the carrier 600 during movement along the preparatory straight rail 301 or to place down the carrier 600 when switching over to the guided straight rail 700 for permitting wheels 601 on the carrier 600 to roll along the rail 700. A programmable controller 400 (see FIG. 10) is mounted on the frame 110 and is coupled with the first and third servomotors 201,3032 via sensors 401,402 mounted on the first servomotor 201 (see FIG. 11) and corresponding to the ring 2021, and a sensor 403 mounted on one end of the threaded rod 3031 (see FIG. 12). The sensors 401,402,403 and the ring 2021 provide additional protection to the apparatus. The third servomotor 3032 further has an encoder 30321 to correspond with a setter 404 of the controller 400. The sensors 2011,30321 are used for detecting, memorizing and controlling the first aligning rod 203 and the carrier transmitting mechanism 303 so that the rod 203 is adjusted automatically to a predetermined position and the carrier 600 is loaded on the loading carrier 302.

In operation, the carrier 600 is first placed on the loading carrier 302. The switch buttons 405 of the controller 400 are pushed to set a desired lateral outreach of a paperboard stack and to initiate movement of the rod 202. Consequently, the paperboard stack is placed on a platform 602 of the carrier 600 and is pushed to abut the front side and one of the lateral sides thereof against the second and first abutment surfaces 11011,2031 for alignment. Once the aligning process of the paperboard stack has been completed, by operating the controller 50, the threaded rod 3031 is driven to rotate so as to move the loading carrier 302 toward the guided straight rail 700 until the sensor 403 stops the third servomotor 3032. As shown in FIG. 14, at this time, the carrier 600 is lowered so that the wheels 601 contact the guided straight rail 700 for subsequent movement toward the printing machine 100 (i.e. toward the stack feeding position). Finally, the third servomotor 3032 operates again via the controller 400 to rotate the threaded rod 3031 in an opposite direction so as to return the loading carrier 302 to its initial position.

Figure 15:
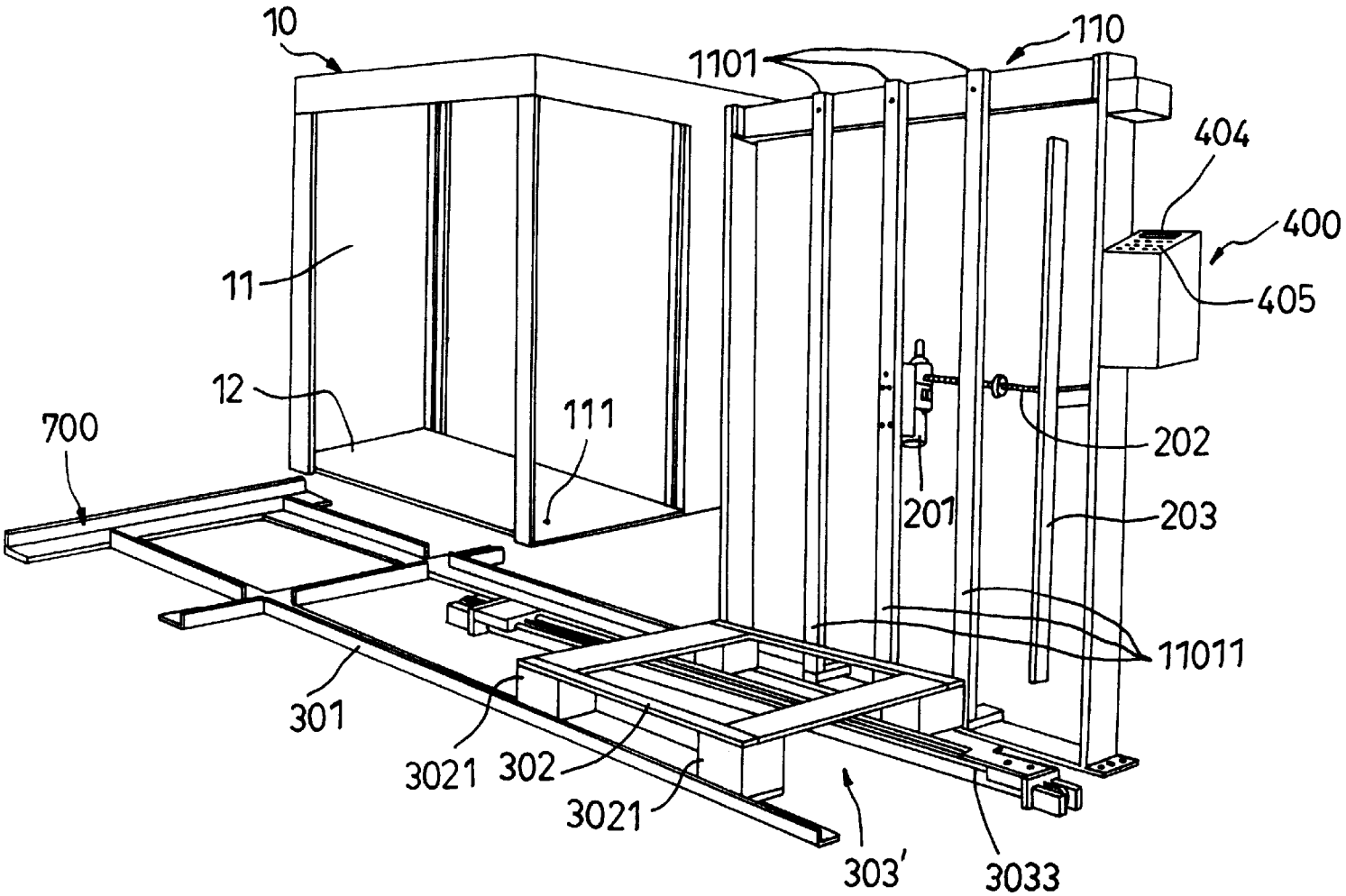
FIG. 15 is a perspective view of a third preferred embodiment of an aligning apparatus according to this invention.

Referring to FIG. 15, the third preferred embodiment of an aligning apparatus according to this invention includes a carrier transmitting mechanism 303' which differs from that of the second preferred embodiment in that a cylinder 3033 is used to drive the movement of the loading carrier 302 along the preparatory straight rail 301.

As illustrated, the aligning apparatus of this invention can be assembled adjacent to the feeding side 11 of the paperboard processing device 10 for aligning sides of the paperboard stack before the stack is carried toward the device 10, thereby increasing the processing efficiency. In addition, the first and second aligning members can be moved toward their desired positions in accordance with the lateral and front sides of the paperboard stack by a controller. By virtue of the positioning mechanism 22, the carrier 20 can be retained in the stack aligning position and the stack feeding position. The paperboard stack can be carried directly toward the paperboard processing device 10 once the aligning process has been completed by moving the carrier from the stack aligning position to the stack feeding position, thereby reducing the labor costs.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An aligning apparatus for aligning sides of a rectangular stack of paperboards carried toward a paperboard processing device, the paperboard stack having a height defined by the volume thereof, two lateral sides parallel to each other and to be aligned in a longitudinal direction of the paperboard stack, and front and rear sides spaced apart from each other by the lateral sides, said aligning apparatus comprising:

a slidable carrier adapted for carrying the paperboard stack, said carrier being movable along a guided straight path in said longitudinal direction from a stack aligning position to a stack feeding position adjacent to the paperboard processing device, said carrier including a platform for supporting the paperboard stack thereon, said platform having two lateral edge portions and front and rear edge portions that correspond respectively to the lateral sides and the front and rear sides of the paperboard stack which is placed thereon;

a first aligning member disposed adjacent to said carrier when said carrier is in said stack aligning position such that said first aligning member is movable relative to one of said lateral edge portions of said carrier, said first aligning member including a first upright flat wall having a first abutment surface adapted to be disposed parallel to the lateral sides of the paperboard stack, and a profile higher than the height of the paperboard stack;

a first electrically driven positioning member disposed to move said first aligning member when said carrier is in said stack aligning position between an extended position, where said first aligning member is proximate to said one of said lateral edge portions of said carrier, and a lateral outreach of the paperboard stack is set in accordance with a width of the paperboard stack, and a first retracted position where said first aligning member is distal to said one of said lateral edge portions of said carrier; and a second aligning member including at least one second upright flat wall having a second abutment surface in a transverse direction relative to said longitudinal direction and a profile higher than the height of the paperboard stack, said second aligning member being disposed adjacent to said carrier when said carrier is in said stack aligning position such that said second aligning member is proximate to said front edge portion of said carrier so that said second abutment surface defines a front outreach of the paperboard stack placed on said platform.

2. The aligning apparatus as claimed in claim 1, further comprising a first servomotor to drive said first electrically driven positioning member to move said first upright flat wall between said extended position and said first retracted position.

3. The aligning apparatus as claimed in claim 2, further comprising a support frame having said first and second aligning members mounted thereon.

4. The aligning apparatus as claimed in claim 2, wherein said guided straight path is a carrier rail, and said carrier has wheels for rolling along said carrier rail, said second aligning member being disposed downstream of said carrier in said longitudinal direction when said carrier is in said stack aligning position so as to permit said second upright flat wall to serve as a barrier for the paperboard stack prior to moving said paperboard stack to said stack feeding position.

5. The aligning apparatus as claimed in claim 4, wherein said second aligning member is retractable in said transverse direction so that said second aligning member can be steered clear of said carriage rail in order to prevent said second aligning member from obstructing movement of said carrier to said stack feeding position.

6. The aligning apparatus as claimed in claim 5, further comprising a second servomotor mounted on said support frame to drive said second aligning member to retract in said transverse direction.

7. The aligning apparatus as claimed in claim 6, further comprising a programmable controller coupled with said first and second servomotors to set said extended position said first aligning member in accordance with the width the paperboard stack.

8. The aligning apparatus as claimed in claim 3, further comprising a preparatory straight path upstream of and criss-crossing said guided straight path for permitting aligning process of the paperboard stack to be carried out thereon.

9. The aligning apparatus as claimed in claim 8, wherein said carrier is moved along said preparatory straight path prior to a switchover to said guided straight path.

10. The aligning apparatus as claimed in claim 9, wherein said second aligning member is secured to said support frame in such a manner that said second upright flat wall is in line with and is parallel to said preparatory straight path to serve a barrier to the front sides of the paperboard stack when said carrier is in said stack aligning position.

11. The aligning apparatus as claimed in claim 9, further comprising a third servomotor to drive movement of said carrier along said preparatory straight path toward said guided straight path.

12. The aligning apparatus as claimed in claim 11, further comprising a programmable controller coupled with said servomotors to set said extended position of said first aligning member in accordance with the width of the paperboard stack and to actuate said third servomotor thereafter.

13. The aligning apparatus as claimed in claim 1, further comprising a positioning mechanism disposed on said platform for retaining said carrier in said stack aligning position and said stack feeding position.

14. The aligning apparatus as claimed in claim 13, wherein said positioning mechanism includes a casing which is secured on an underside of said platform, a positioning rod which is received in said casing, which has upper and lower ends opposite to each other in a direction normal to said platform, and which is disposed to be movable downwardly and to have said lower end outwardly of said casing, a biasing spring which engages said upper end of said positioning rod to bias said positioning rod upward so as to retract said lower end inwardly of said casing, and an operating rod which is connected to said positioning rod and which extends radially and outwardly of said casing such that when said carrier is in one of said stack aligning position and said stack feeding position, said operating rod can be operated to drive said positioning rod to rotate relative to said casing and to be held from moving upward once said operating rod has brought said positioning rod to move downward against the biasing action of said biasing spring to extend said lower end outwardly of said casing so as to reach and abut against the ground.

15. The aligning apparatus as claimed in claim 14, wherein said positioning mechanism has a positioning hole formed under said positioning rod when said carrier is in said stack aligning position so as to engage said lower end of said positioning rod therein.

16. The aligning apparatus as claimed in claim 14, wherein said positioning mechanism has a positioning hole formed under said positioning rod when said carrier is in said stack feeding position so as to engage said lower end of said positioning rod therein.

* * * * *